US008269124B2

(12) United States Patent
Jung et al.

(10) Patent No.: US 8,269,124 B2
(45) Date of Patent: Sep. 18, 2012

(54) DOME SWITCH STRUCTURE FOR A PORTABLE TERMINAL

(75) Inventors: Jae-Jun Jung, Seoul (KR); Eun-Taek Oh, Incheon (KR); Yong-Il Kim, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 232 days.

(21) Appl. No.: 12/696,998

(22) Filed: Jan. 29, 2010

(65) Prior Publication Data

US 2010/0264007 A1 Oct. 21, 2010

(30) Foreign Application Priority Data

Apr. 20, 2009 (KR) ..... 10-2009-0034365
Apr. 20, 2009 (KR) ..... 10-2009-0034366

(51) Int. Cl.
*H01H 1/10* (2006.01)

(52) U.S. Cl. ..... 200/513

(58) Field of Classification Search ..... 200/516, 200/406, 513

See application file for complete search history.

(56) References Cited

U.S. PATENT DOCUMENTS

| | | | | |
|---|---|---|---|---|
| 6,140,596 | A | 10/2000 | Tsay | |
| 6,563,068 | B2 * | 5/2003 | Yamagata et al. | 200/406 |
| 2003/0209418 | A1 * | 11/2003 | Yanai et al. | 200/406 |
| 2003/0221943 | A1 * | 12/2003 | Masuda | 200/406 |
| 2011/0155554 | A1 * | 6/2011 | Kataoka et al. | 200/516 |

FOREIGN PATENT DOCUMENTS

| | | | |
|---|---|---|---|
| EP | 1 225 607 | A2 | 7/2002 |
| JP | 05-325709 | A | 12/1993 |
| JP | 2002-290000 | A | 10/2002 |

* cited by examiner

*Primary Examiner* — Vanessa Girardi
(74) *Attorney, Agent, or Firm* — Birch, Stewart, Kolasch & Birch, LLP

(57) ABSTRACT

Disclosed is a portable terminal, including, a first conductor formed on one surface of a board and having a contact surface, a second conductor formed at an outer periphery of the first conductor and having a support surface, and a metal dome supported by the support surface and transformed responsive to a key being pressed so as to contact the contact surface, wherein the contact surface is located at a position lower than the support surface so as to increase a transformation stroke of the metal dome.

8 Claims, 14 Drawing Sheets

DOME SWITCH STRUCTURE FOR A PORTABLE TERMINAL

CROSS-REFERENCE TO RELATED APPLICATION

Pursuant to 35 U.S.C. §119(a), this application claims the benefit of earlier filing date and right of priority to Korean Applications No. 10-2009-0034365 and 10-2009-0034366, both filed on Apr. 20, 2009, the contents of which is incorporated by reference herein in its entirety.

BACKGROUND OF THE INVENTION

1. Field of the Invention

The present invention relates to a portable terminal having a dome switch with an enhanced click feeling.

2. Background of the Invention

Portable terminals can be easily carried and have one or more of functions such as supporting voice and video telephony calls, inputting and/or outputting information, storing data and the like.

As it becomes multifunctional, the portable terminal can be allowed to capture still images or moving images, play music or video files, play games, receive broadcast and the like, so as to be implemented as an integrated multimedia player.

Various new attempts have been made for the multimedia devices by hardware or software in order to implement such complicated functions. For example, a user interface environment is provided in order for users to easily and conveniently retrieve or select functions.

A portable terminal has input devices for inputting information by a user's manipulation. Such an input device may be implemented as a dome switch or a touch pad which allows a user to input commands or information by pushing or touching the same, or a wheel, a jog or a joystick manipulated in a manner of rotating keys.

Among others, the dome switch has a simple reliable structure and provides a user with click feeling. Such advantages render the dome switch most typically employed in the portable terminal.

SUMMARY OF THE INVENTION

Therefore, an object of the present invention is to provide a structure of a dome switch capable of enhancing user's click feeling upon pressing a keypad.

To achieve these and other advantages and in accordance with the purpose of the present invention, as embodied and broadly described herein, there is provided a portable terminal including, a first conductor formed on one surface of a board and having a contact surface, a second conductor formed at an outer periphery of the first conductor and having a support surface, and a metal dome supported by the support surface and transformed responsive to a key being pressed so as to contact the contact surface, wherein the contact surface is located at a position lower than the support surface so as to increase a transformation stroke of the metal dome.

In another aspect of the present invention, there is provided a portable terminal including, a first conductor patterned on a board, a second conductor patterned on an outer periphery of the first conductor, a metal dome electrically connected to the second conductor and transformed responsive to a key being pressed so as to contact the first conductor, and an elastic supporting member configured to support a supported point of the metal dome in a state of being supported by the second conductor, and elastically move the support point of the metal dome when the key is pressed.

The foregoing and other objects, features, aspects and advantages of the portable terminal according to the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of a portable terminal in accordance with the preferred embodiments of the present invention, with reference to the accompanying drawings.

Figure 1:
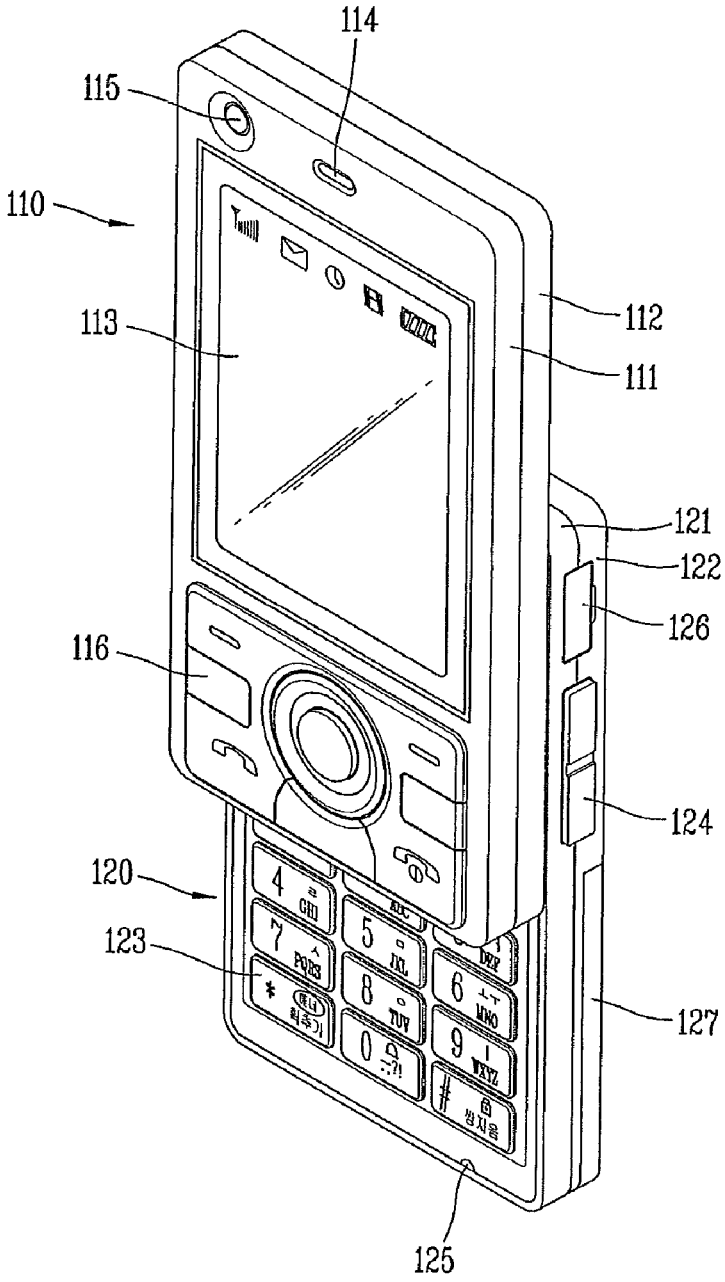
FIG. 1 is a front perspective view of a portable terminal in accordance with one embodiment of the present invention.

FIG. 1 is a front perspective view of a portable terminal 100 in accordance with one embodiment of the present invention.

A portable terminal 100 may include a first body 110 and a second body 120 slidable to the first body 110 in at least one direction. Here, this embodiment illustrates a slide type portable terminal; however, the present invention may not be limited to the configuration. The present invention may also be applicable to various types of portable terminals, such as bar type, folder type, swing type, swivel type and the like.

The state where the first body 110 is positioned over the second body 120 may be referred to as a closed configuration (position). Also, the state where the first body 110 exposes at least part of the second body 120, as shown in FIG. 1, can be referred to as an open configuration (position).

In addition, the portable terminal 100 may typically be operable in a standby (idle) mode when in the closed configuration, but this mode can be released by the user's manipulation. Also, the portable terminal 100 may be operable in an active (phone call) mode in the open configuration. This mode may also be changed into the idle mode according to the user's manipulation or after a certain time elapses.

A case (housing, casing, cover, etc.) forming the outside of the first body 110 is formed by a front case 111 and a rear case 112. In addition, various electronic components may be disposed in a space between the front case 111 and the rear case 112.

At least one intermediate case may additionally be disposed between the front case 111 and the rear case 112.

Further, the cases can be formed of resin in a manner of injection molding, or formed using metallic materials such as stainless steel (STS) and titanium (Ti).

A display 113, an audio output unit 114, a first video input unit 115 or a first manipulation unit 116 may be disposed on the first body 110, in detail, on the front case 111.

The display 113 may be configured to display visible information, examples of which include a liquid crystal display (LCD) module, an organic light emitting diodes (OLED) module and the like. The display 113 may further include a touch screen so as to allow a user to input information by a touch input.

The audio output unit 114 may be configured as a receiver or a speaker. The first video input unit 115 may be a camera module for allowing a user to capture images or video.

The first manipulation unit 116 may receive a command input to control the operation of the portable terminal 100 according to the one embodiment of the present invention.

Similar to the first body 110, a front case 121 and a rear case 122 may configure a case of the second body 120. A second manipulation unit 123 may be disposed at the second body 120, more particularly, at a front face of the front case 121.

A third manipulation unit 124, an audio input unit 125 and an interface 126 may be disposed on at least one of the front case 121 or the rear case 122.

The first to third manipulation unit 116, 123 and 124 can be referred to as a manipulation portion, which can be manipulated in any tactile manner that user can make a touch input.

For example, the manipulation portion can be implemented as a dome switch or touchpad which can receive information or commands input by a user in a pushing or touching manner, or implemented in a manner of using a wheel, a jog or a joystick to rotate keys.

Regarding each function, the first manipulation unit 116 can be used for inputting commands such as START, END, SCROLL or the like, and the second manipulation unit 123 can be used for inputting numbers, characters, symbols, or the like. Also, the third manipulation unit 124 can function as a hot key for activating a specific function, such as activation of the first video input unit 115.

The audio input unit 125 may be configured as a microphone so as to receive user's voice, other sounds and the like.

The interface 126 may interface the portable terminal 100 and external devices so as to allow data exchange therebetween or the like. For example, the interface 126 may be at least one of a wired/wireless access terminal for earphones, a short-range communication port (e.g., IrDA port, BLUETOOTH port, wireless Lan port, and the like), and power supply terminals for supplying power to the portable terminal.

The interface 126 may be a card socket for accommodating an external card such as Subscriber Identification Module (SIM), User Identity Module (UIM), memory card for storing information, or the like.

A power supply unit 127 for supplying power to the portable terminal 100 may be mounted in the rear case 122. For example, the power supply unit 127 may be a rechargeable battery so as to be detachable for charging.

Figure 2:
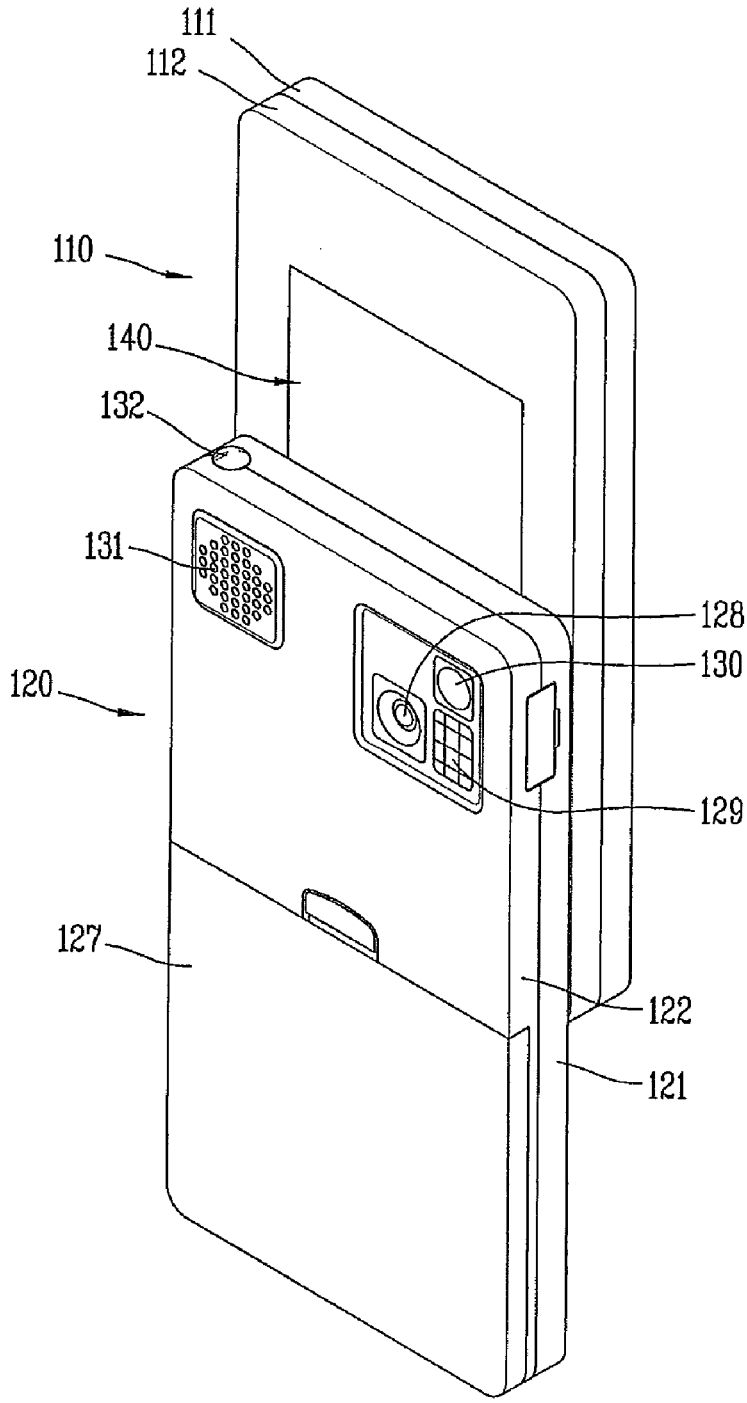
FIG. 2 is a rear perspective view of the portable terminal in accordance with the one embodiment of the present invention.

FIG. 2 is a rear perspective view of the portable terminal of FIG. 1.

Referring to FIG. 2, a second video input unit 128 may further be disposed on the rear case 122 of the second body 120. The second video input unit 128 faces a direction which is substantially opposite to a direction faced by the first video input unit 115 (see FIG. 1). Also, the second video input unit 128 may be a camera having different pixels from those of the first video input unit 115.

For instance, the first video input unit 115 may operate with relatively lower pixels (lower resolution). Thus, the first video input unit 115 may be useful when a user can capture his face and send it to another party during a video call or the like. On the other hand, the second video input unit 128 may operate with relatively higher pixels (higher resolution) such that it can be useful for a user to obtain higher quality pictures for later use.

A flash 129 and a mirror 130 may be disposed adjacent to the second video input unit 128. The flash 129 operates in conjunction with the second video input unit 128 when taking a picture using the second video input unit 128. The mirror 130 can cooperate with the second video input unit 128 to allow a user to photograph himself in a self-portrait mode.

A second audio output unit 131 may further be disposed at the rear case 122.

The second audio output unit 131 can cooperate with the first audio output unit 114 (see FIG. 1) to provide stereo output.

Also, at the rear case 122 may be disposed a broadcast signal receiving antenna 132, as well as an antenna for call communications or the like. The antenna 132 may retract into the second body 120.

A part of a slide module 133 for slidably coupling the first body 110 to the second body 120 may be disposed at the rear case 112 of the first body 110.

Another part of the slide module 133 may be disposed at the front case 121 of the second body 120, so as not to be exposed to the exterior as shown in FIG. 2.

As described above, it has been described that the second video input unit 128 is disposed at the second body 120; however, the present invention may not be limited to the configuration. It is also possible that one or more of those components (e.g., 128 to 132), which have been described to be implemented on the rear case 122, such as the second video input unit 128, will be implemented on the first body 110, particularly, on the rear case 112. In this configuration, the component(s) disposed on the rear case 112 can be protected by the second body 120 in a closed state of the portable terminal. In addition, without the second video input unit 128, the first video input unit 115 can be implemented to be rotatable so as to rotate up to a direction which the second video input unit 128 faces.

Figure 3:
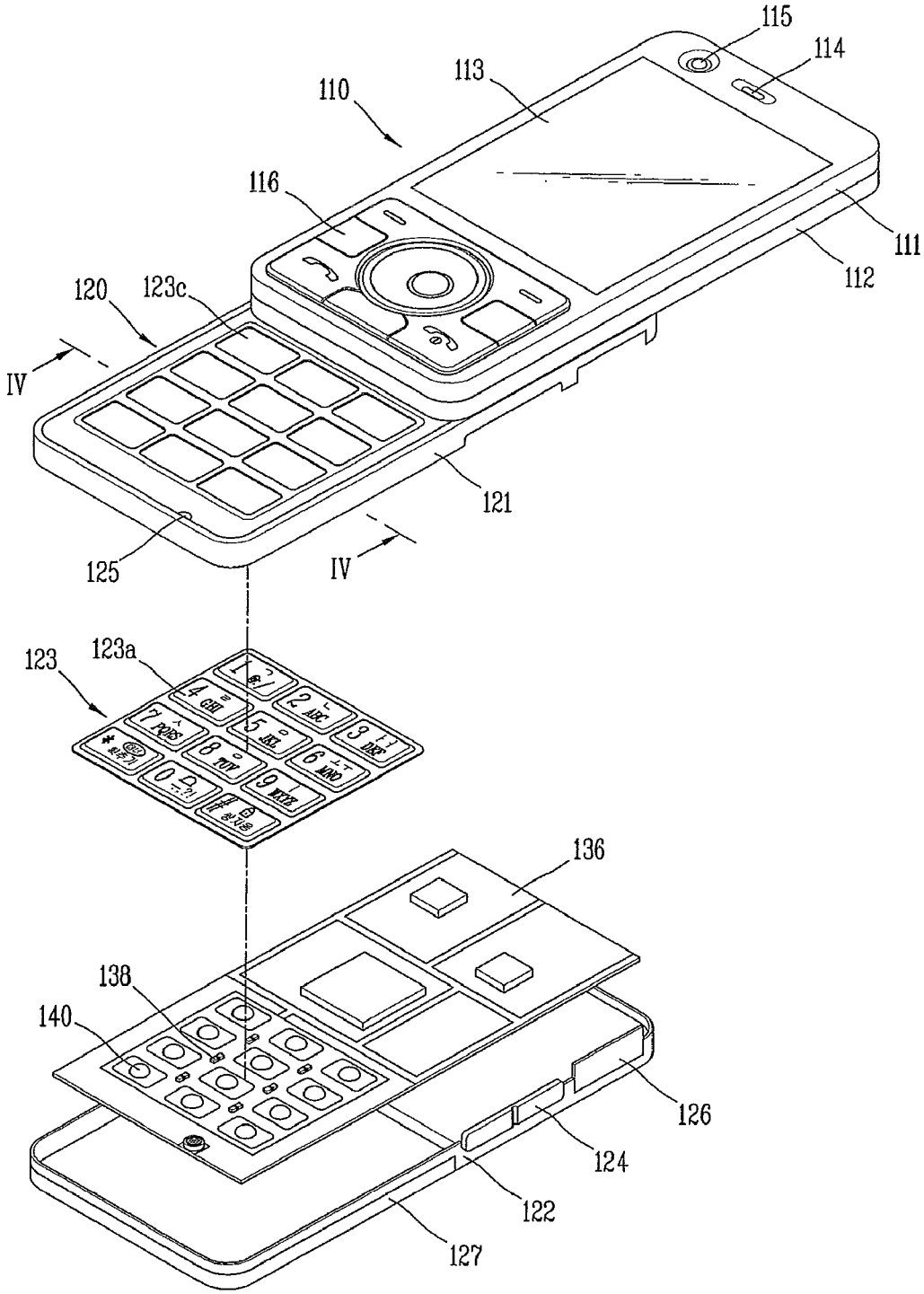
FIG. 3 is a disassembled perspective view of the portable terminal in accordance with the one embodiment of the present invention.
Figure 4:
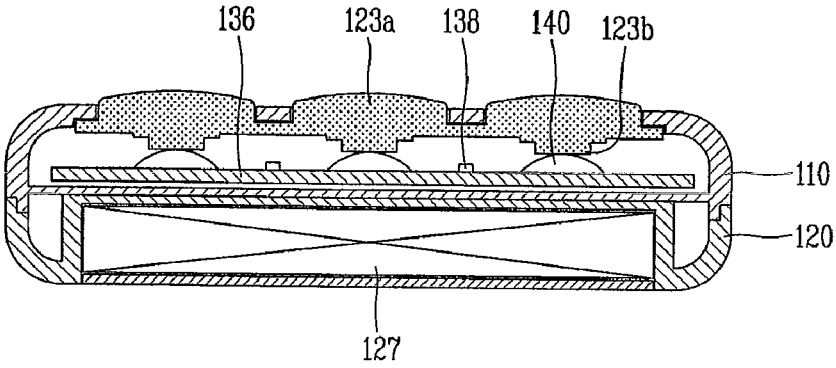
FIG. 4 is a sectional view of the portable terminal taken along the line IV-IV of FIG. 3.

FIG. 3 is a disassembled perspective view of the portable terminal in accordance with the one embodiment of the present invention, and FIG. 4 is a sectional view of the portable terminal taken along the line IV-IV of FIG. 3.

The second manipulation unit 123 according to the present invention may be implemented as a plurality of key buttons 123*a* operable in a pressing manner. This embodiment exemplarily illustrates that individual key buttons 123*a* are mounted on the second body 120; however, the second manipulation unit 123 may be implemented in a type of 'keypad' having integrally-formed key buttons 123*a*.

A printed circuit board 136 having electric components, which allow operations of the portable terminal, may be mounted between the front case 121 and the rear case 122. This embodiment exemplarily illustrates a rigid PCB as the printed circuit board 136; however, a flexible PCB (FPCB) may also be useable.

The printed circuit board 136 may have dome switches 140 for generating signals responsive to press inputs via the key buttons 123*a*. Push protrusions 123*b* by which the dome switches 140 are pushed may be formed on a rear surface of the key buttons 123*a*, respectively. Upon pressing a key button 123*a*, the corresponding dome switch 140 is pressed by the push protrusions 123*b*. Also, as the dome switch 140 is transformed (i.e., pressed) to some degree, an input signal is generated.

Illumination units 138 for illuminating the key buttons 123*a* may be mounted between the dome switches 140 of the printed circuit board 136. The illumination units 138 may be employed to illuminate numbers, characters, symbols designated on the key buttons 123*a*. The illumination unit 138 may be configured as a light emitting diode (LED) so as to reduce power loss and fabricating cost.

A metal dome 143 (see FIG. 7) of each dome switch 140 may be attached onto the printed circuit board 136 by use of an adhesive tape having a preset area, and an example of the adhesive tape may include a light guide film for guiding light emitted from the illumination unit 138.

Figure 5A:
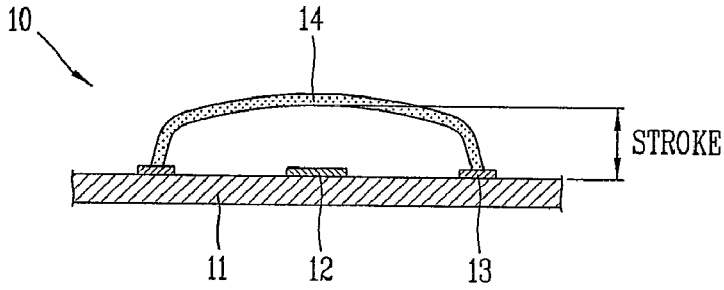
FIGS. 5A and 5B are sectional views showing a structure and an operation state of a typical type of dome switch.
Figure 5B:
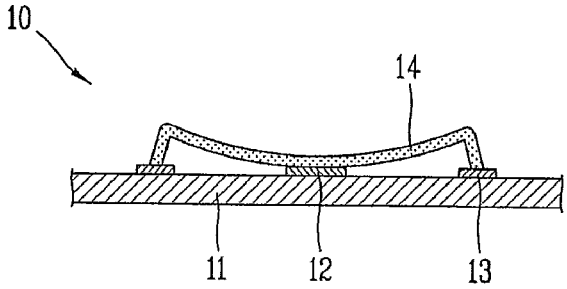
Figure 6:
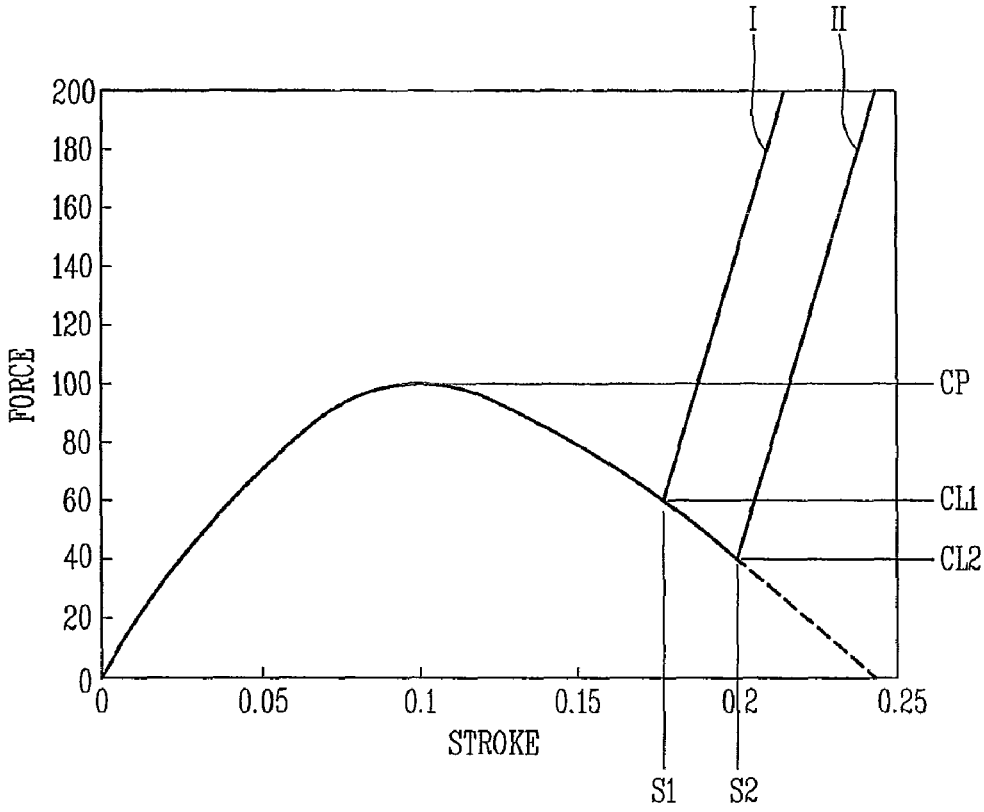
FIG. 6 is a graph showing strength of force applied to a metal dome depending on a transformation of the metal dome.

FIGS. 5*a* and 5*b* are sectional views showing a structure and an operation state of a typical type of dome switch, and FIG. 6 is a graph showing strength of a force applied to a metal dome depending on a transformation of the metal dome.

Referring to FIGS. 5*a* and 5*b*, a dome switch 10 may include first and second conductors 12 and 13 patterned on a board 11, and a metal dome 14 for electrically connecting the first and second conductors 12 and 13 to each other when being pressed.

The first conductor 12 may be located at a position aligned with a central portion of the metal dome 14. The second conductor 13 may be formed in a shape of ring or band surrounding a periphery of the first conductor 12. The metal dome 14 may be supported by the second conductor 13.

If the metal dome 14 is pressed in the state of FIG. 5A, the dome 14 is transformed. Thus, as shown in FIG. 5B, the central portion of the metal dome 14 is moved (pressed down) to be in contact with the first conductor 12. Accordingly, the first and second conductors 12 and 13 are electrically connected to each other, thereby generating an input signal. Hereinafter, a distance that the central portion of the metal dome 14 is moved is referred to as a stroke.

A horizontal axis of the graph shown in FIG. 6 indicates a stroke and a vertical axis indicates the strength of force applied onto the metal dome 14.

As shown in the graph of FIG. 6, the strength of force applied to the metal dome 14 increases in proportion to the stroke and decreases from a specific point. The strength of force at this specific point may be preferred to as a compress peak (CP) value, and buckling may occur at an edge of the metal dome 14 at this specific point.

The force applied to the metal dome 14, which was being decreased, is then increased again from the specific point by the buckling. This is caused when the central portion of the metal dome 14 comes in contact with the first conductor 12. The strength of the force at this point may be referred to as a compress low (CL) value.

As such, the strength of the force applied to the metal dome 14 may be varied depending on a transformed degree (level) of the metal dome 12. This is transferred to a user as a type of click feeling. A concept of 'Click ratio' for numerically representing such click feeling may be introduced. Here, the 'click ratio' may be represented in the following formula.

$$\text{Click ratio} = \frac{CP - CL}{CP} \times 100$$

Typically, it has been known that the click feeling is enhanced when the click ratio is high. Comparing a first curved line I with a second curved line II shown in the graph of FIG. 6, it can be noticed that the second curved line II has a CL value CL2 lower than a CL value CL1 of the first curved line I and additionally the second curved line II has a stroke value S2 greater than a stroke value S1 of the first curved line I.

That is, since the second curved line II has a greater difference value between CP value and CL value (i.e., CP−CL) than the first curved line I, it can be known that the second curved line II has a click ratio higher than that of the first curved line I. Hence, the click ratio can be increased by increasing the stroke value of the metal dome 14.

The present invention provides a structure of a dome switch capable of increasing the click ratio by increasing the stroke value of the metal dome 14.

Figure 7:
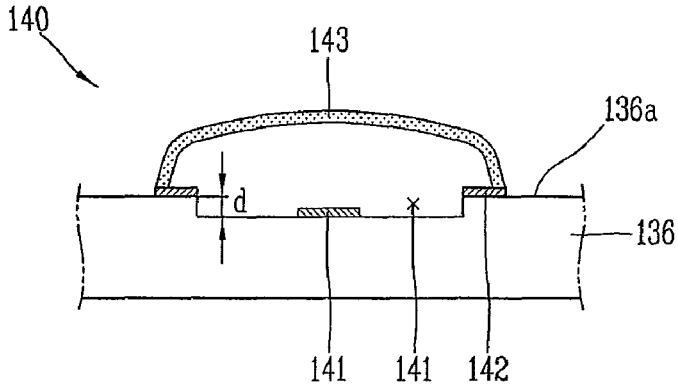
FIG. 7 is a sectional view of a dome switch in a $1^{st}$ embodiment of the present invention.

FIG. 7 is a sectional view of a dome switch in accordance with a 1$^{st}$ embodiment of the present invention.

As shown in FIG. 7, the dome switch 140 may include a first conductor 141 formed on one surface of the printed circuit board 136, a second conductor 142 formed at an outer periphery of the first conductor 140, and a metal dome 143 transformed responsive to the key 123*a* being pressed.

The first conductor 141 may have a contact surface to be contactable with the metal dome 143 upon the transformation of the metal dome 143, and the second conductor 142 may have a support surface for supporting the metal dome 143.

An edge of the metal dome 143 may be supported on the support surface of the second conductor 142. Upon being transformed, a central portion of the metal dome 143 may be moved to come in contact with the contact surface of the first conductor 141.

The present invention introduces a structure in which the contact surface of the first conductor 141 is located lower than the support surface of the second conductor 142 so as to increase a stroke of the metal dome 143 upon the transformation of the metal dome 143.

In order to implement the structure of this embodiment, the first conductor 141 has been located lower than a principal surface 136*a* or an upper surface of the printed circuit board 136.

As one example of this structure, a structure may be proposed in which a recess portion 144 is recessed into the printed circuit board 136 by a preset depth d. The first conductor 141 may be formed on the recess portion 144 and the second conductor 142 may be formed outside the recess portion 144.

The first conductor 141 and the second conductor 142 may have various thicknesses depending on a height difference between the contact surface and the support surface.

In accordance with this embodiment, the first and second conductors 141 and 142 may have the same thickness. In this case, a fabrication process of the dome switch 140 will be the same to that of the existing dome switch excluding a procedure of forming the recess portion 144, thereby implementing the structure of the dome switch 140 according to the present invention without a great change in the fabrication process.

Figure 8:
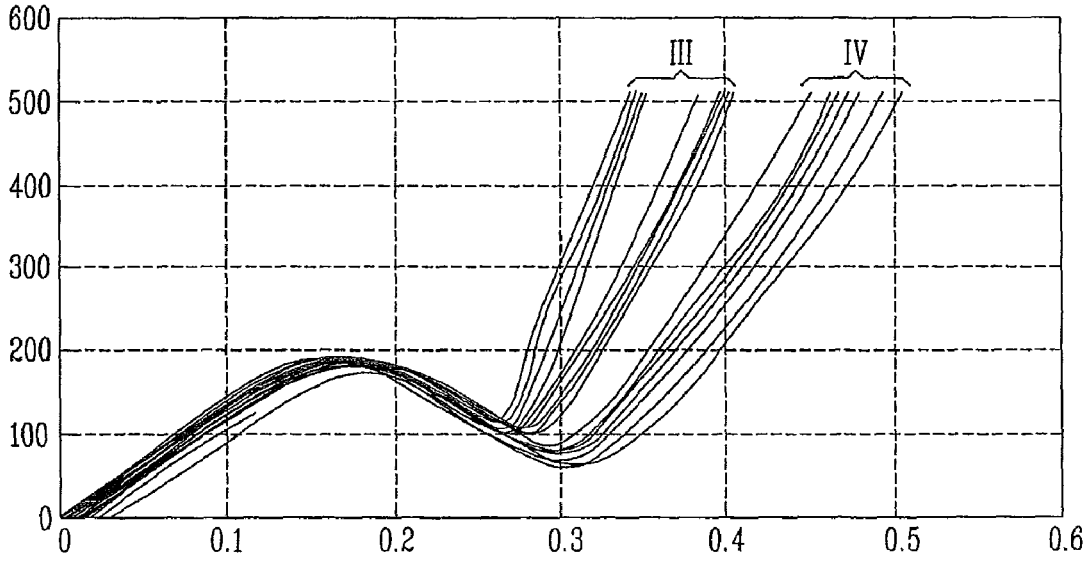
FIG. 8 is a graph showing the measurements of forces applied to a metal dome responsive to the transformation of the metal dome of the dome switch in accordance with the $1^{st}$ embodiment of the present invention.

FIG. 8 is a graph showing the measurements of forces applied to a metal dome responsive to the transformation of the metal dome of the dome switch in accordance with the $1^{st}$ embodiment of the present invention.

In FIG. 8, a third curved line III indicates that the contact surface of the first conductor 141 and the support surface of the second conductor 142 have the same height, and a fourth curved line IV indicates that the recess portion 144 is formed at the printed circuit board 136 so that the contact surface of the first conductor 141 is located lower than the support surface of the second conductor 142. The measurement values of the third curved line III and the fourth curved line IV are represented in the following table.

| | III | IV |
|---|---|---|
| CP (gf) | 185 | 184 |
| CL (gf) | 100 | 67 |
| Click ratio (%) | 46.1 | 63.3 |
| Stroke (mm) | 0.274 | 0.295 |

Referring to the measurement results, it can be seen that the click ratio is increased by 18% from 46.1% to 63.3% when the contact surface and the support surface have a height difference of 0.002 mm. Consequently, it can be noticed that the click ratio can be remarkably increased by a slight increase in the stroke of the metal dome 143.

Figure 9:
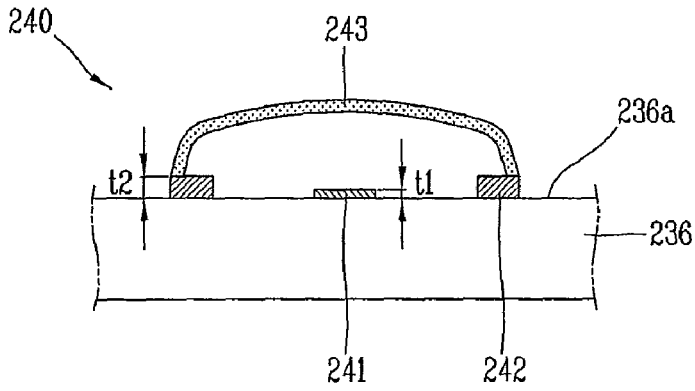
FIGS. 9 to 12 are sectional views showing dome switches in accordance with $2^{nd}$ to $5^{th}$ embodiments of the present invention.

FIG. 9 is a sectional view of a dome switch in accordance with a $2^{nd}$ embodiment of the present invention.

A dome switch 240 according to this embodiment may also include a first conductor 241, a second conductor 242 and a metal dome 243. A contact surface of the first conductor 241 may be formed at a position lower than a support surface of the second conductor 242. The similar reference numerals have been given in FIG. 9 to the same components to those of the previous embodiment.

Unlike the previous embodiment, this embodiment exemplarily illustrates that the contact surface of the first conductor 241 and the support surface of the second conductor 242 are located higher than a principal surface 236*a* of a printed circuit board 236.

The first and second conductors 241 and 242 may be disposed on the principal surface 236*a* of the printed circuit board 236. That is, the first and second conductors 241 and 242 may be disposed on the same surface of the printed circuit board 236 and the second conductor 242 may have a thickness t2 thicker than a thickness t1 of the first conductor 241.

Accordingly, a structure can be implemented in which the contact surface of the first conductor 241 is formed at a position lower than the support surface of the second conductor 242. This embodiment can achieve a structure of increasing the stroke of the metal dome 243 without performing a process of forming a recess portion on a board.

Figure 10:
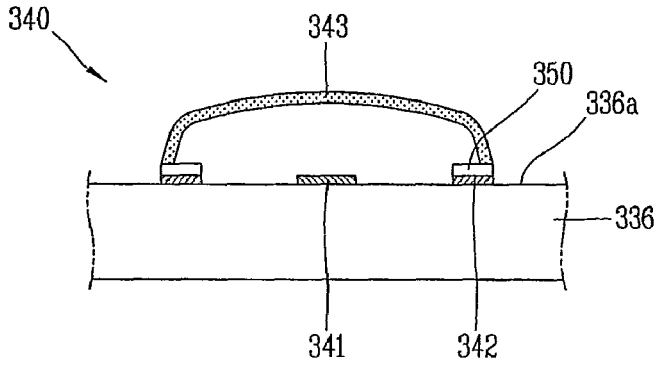
Figure 11:
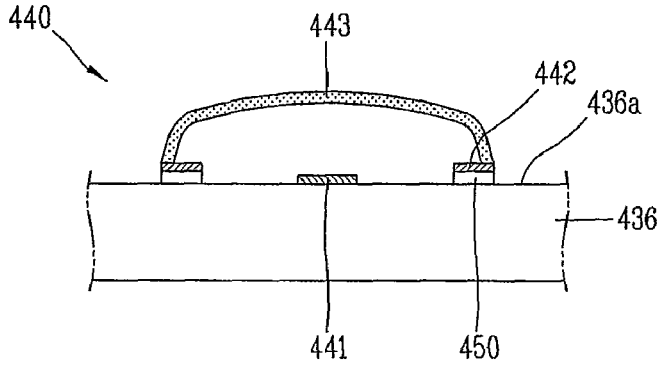

FIGS. 10 and 11 are sectional views of dome switches in accordance with $3^{rd}$ and $4^{th}$ embodiments of the present invention. In FIGS. 10 and 11, the similar reference numerals have been given to the same components to those of the previous embodiment.

Each of dome switches 340 and 440 according to these embodiments may also have a structure in which a contact surface of a first conductor 341, 441 and a support surface of a second conductor 342, 442 is located higher than a principal surface 336*a*, 436*a* of a printed circuit board 336, 436.

Each of the dome switches 340 and 440 according to these embodiments may further include a supporting member 350, 450 for increasing a height of a supported point of the metal dome 343, 443.

Referring to FIG. 10, the supporting member 350 may be formed in a ring shape or a donut shape with a preset thickness. The supporting member 350 may be disposed between an upper surface of the second conductor 342 and the supported point of the metal dome 343, and made of a conductive material so as to electrically connect the second conductor 342 to the metal dome 343.

These embodiments illustrate that the first conductor 341, 441 have the same thickness to the second conductor 342, 442; however, different thicknesses may also be available.

Referring to FIG. 11, a supporting member 450 may be disposed between the second conductor 442 and the printed circuit board 436. The supporting member 450 employed in this embodiment may be formed either of a conductive material or of a non-conductive material.

This embodiment exemplarily illustrates that the supporting member 450 may be formed separately from the printed circuit board 436; however, it may be formed integrally with the printed circuit board 436. In this case, the supporting member 450 can be formed of an insulating material, which forms the printed circuit board 436.

Figure 12:
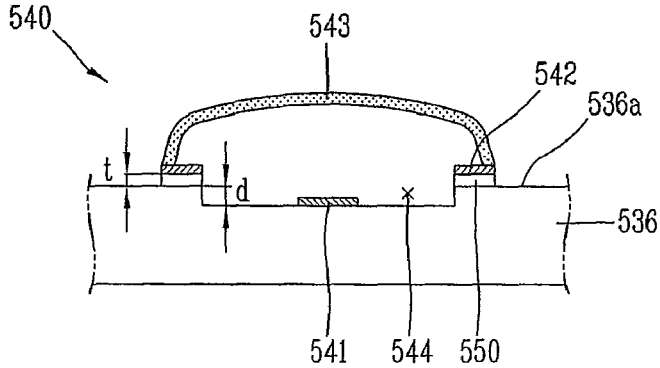

FIG. 12 is a sectional view of a dome switch in accordance with a $5^{th}$ embodiment of the present invention. Similar to the previous embodiment, in FIG. 12, similar reference numerals have been given to the same components to those of the previous embodiment.

A dome switch 540 according to this embodiment is configured so that a recess portion 544 is formed at a printed circuit board 536 and a supporting member 550 is disposed at an outer periphery of the recess portion 544 so as to increase the stroke of a metal dome 543. The structure is achieved by additionally forming the recess portion 544 with a predetermined depth at an inner region of the supporting member 450 of the dome switch 440 according to the $4^{th}$ embodiment.

With this structure, a height of a first conductor 541 can be decreased by the depth d of the recess portion 544 and a height of a second conductor 542 can be increased by a thickness t of the supporting member 550. Consequently, a height difference between the contact surface of the first conductor 541 and the support surface of the second conductor 542 can be increased that much.

This structure has the advantage of increasing the stroke of the metal dome 543 as much as possible even without greatly increasing the height between the lower surface of the printed circuit board 536 and the upper end of the metal dome 543.

As described above, the structures capable of enhancing the click ratio by increasing the stroke of the metal dome have been illustrated. Meanwhile, besides the click ratio, 'tactile response slop (TRS)' may be introduced as another concept for numerically representing click feeling.

Figure 13:
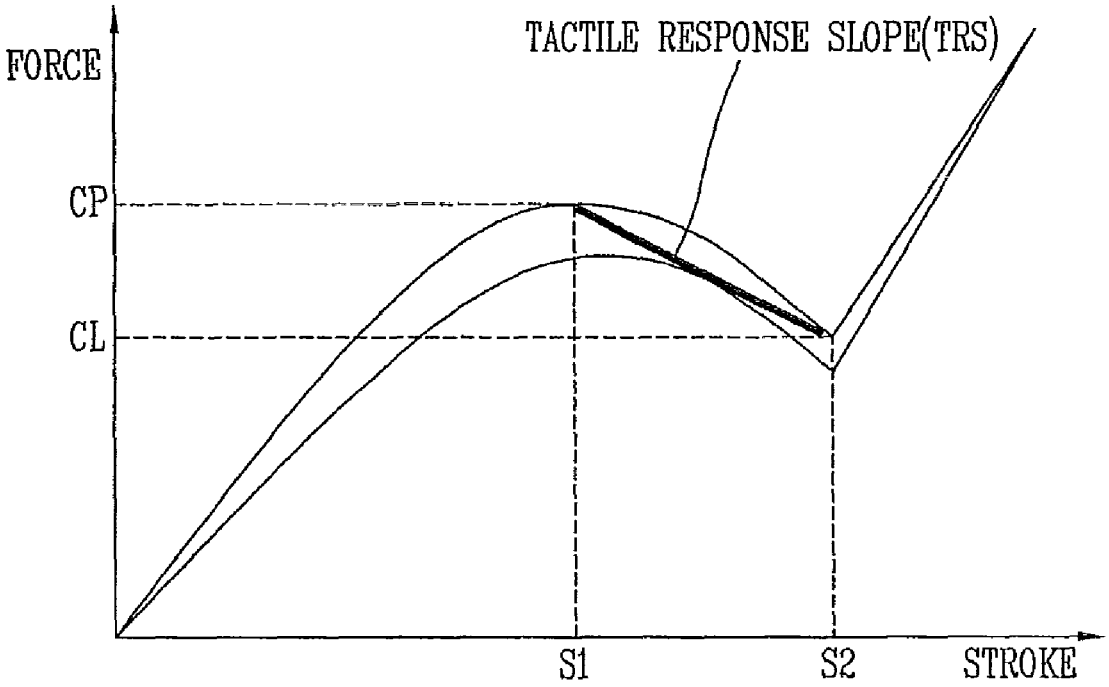
FIG. 13 is a graph showing a concept of tactile response slope (TRS)

FIG. 13 is a graph showing the concept of TRS, which shows the strength of forces applied to a metal dome responsive to the transformation of the metal dome. A horizontal axis of the graph indicates a stroke and a vertical axis thereof indicates the strength of force applied to a metal dome 14.

Here, TRS may be represented as the following formula;

$$TRS = \frac{CP - CL}{S_2 - S_1}$$

where the CP value and the CL value are the same as those shown in FIG. 6, and S1 and S2 denote strokes corresponding to the CP value and the CL value, respectively. TRS denotes an approximate inclination of a curved line at an interval between S1 and S2.

It has generally been known that as TRS increases, click feeling is enhanced.

FIGS. 14A to 14C and FIGS. 15A to 15C are conceptual views showing a method for increasing TRS.

Figure 14A:
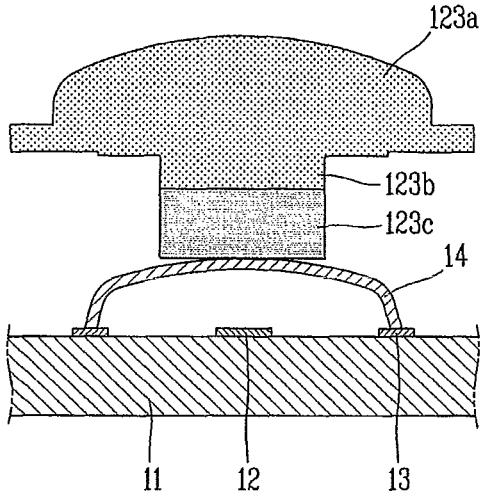
FIGS. 14A to 14C are conceptual views showing one embodiment of a method for increasing TRS.
Figure 14B:
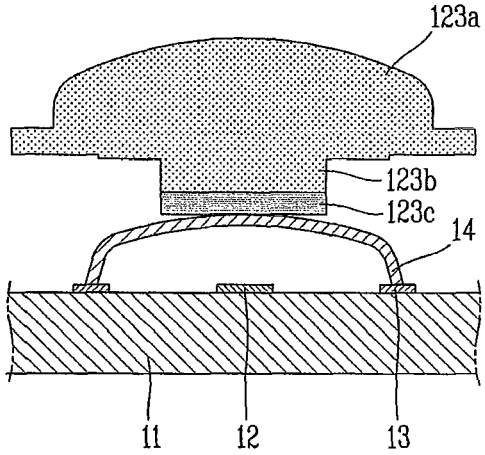
Figure 14C:
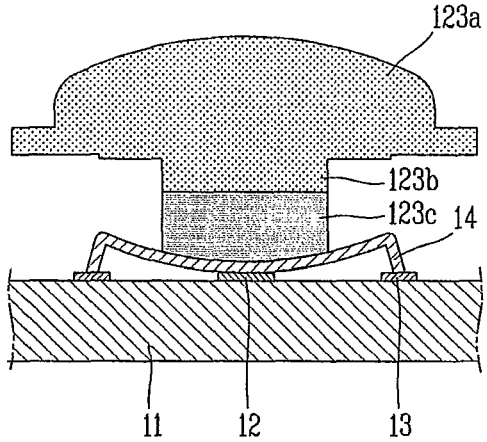

FIGS. 14A to 14C show a method for forming an elastic member 123*c* at an end portion of the push protrusion 123*b* as an example of increasing TRS. Here, the elastic member 123*c* may be formed of rubber or silicon.

As the push protrusion 123*b* is lowered responsive to the key button 123*a* being pressed, the elastic member 123*c* may be compressed. When the compressed elastic member 123*c* is restored to its original state, buckling may be generated at an edge of the metal dome 14.

The following table shows measurements of CP value, click ratio, stroke and TRS according to a length of the elastic member 123*c*.

| | 0(mm) | 0.2(mm) | 0.4(mm) | 0.6(mm) | 0.8(mm) | 1.0(mm) |
|---|---|---|---|---|---|---|
| CP(gf) | 210 | 212 | 218 | 223 | 225 | 226 |
| Click ratio (%) | 55.5 | 56.1 | 56.1 | 56.6 | 56.9 | 54.0 |
| Stroke (mm) | 0.210 | 0.236 | 0.262 | 0.285 | 0.311 | 0.337 |
| TRS | 1209 | 1258 | 1547 | 2074 | 2954 | 3944 |

Referring to the table, it can be seen that TRS value has been more increased upon employing the elastic member 123*c* than upon not employing the elastic member 123*c*. It can also be noticed that the increase in the length of the elastic member 123*c* proportionally causes the increase in the TRS value.

Figure 15A:
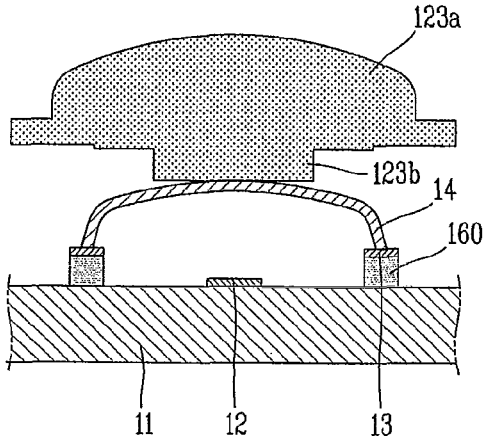
FIGS. 15A to 15C are conceptual views showing another embodiment of a method for increasing TRS.
Figure 15B:
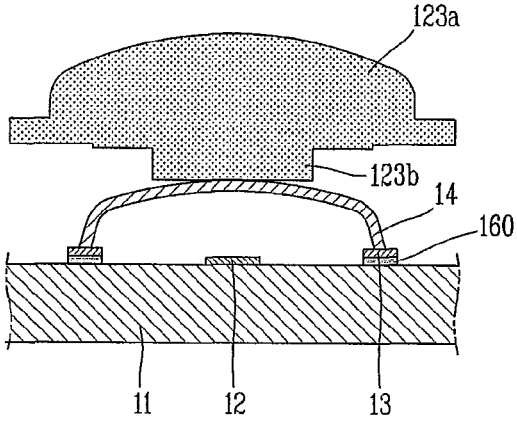
Figure 15C:
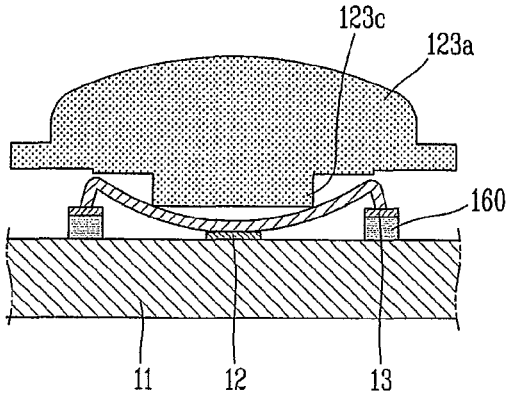

FIGS. 15A to 15C show a method for elastically moving a supported point of the metal dome 14 as another method for increasing TRS.

To this end, a dome switch may include an elastic supporting member 160 for elastically supporting the metal dome 14. Here, the elastic supporting member 160 may be formed of a conductive material and have an elastic index smaller than that of the metal dome 14.

As the push protrusion 123*b* is lowered responsive to the key button 123*a* being pressed, the elastic supporting member 160 may be compressed. When the compressed elastic supporting member 160 is restored to its original state, buckling may be generated at an edge of the metal dome 14.

This method has an advantage of implementing a stable structure of the dome switch and achieving a TRS-increased structure without greatly affecting the thickness of the terminal. Hereinafter, description will be given of embodiments focusing on such structure.

Figure 16A:
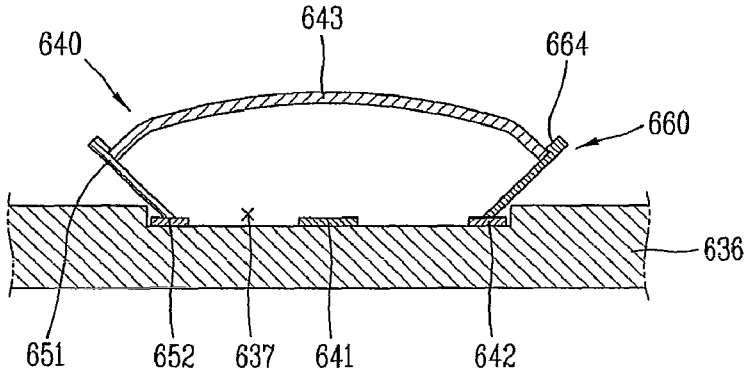
FIGS. 16A to 16C are sectional views showing a dome switch in accordance with a $6^{th}$ embodiment of the present invention.
Figure 16B:
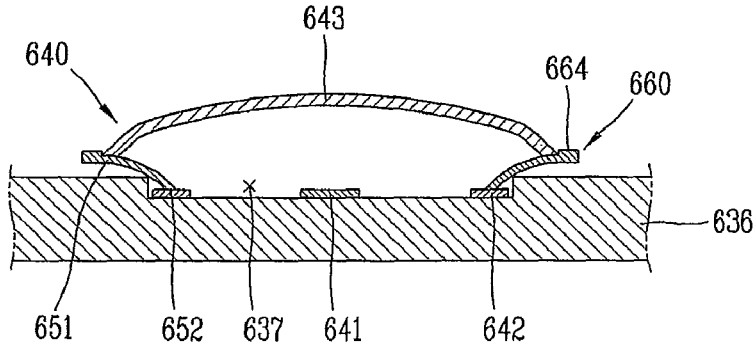
Figure 16C:
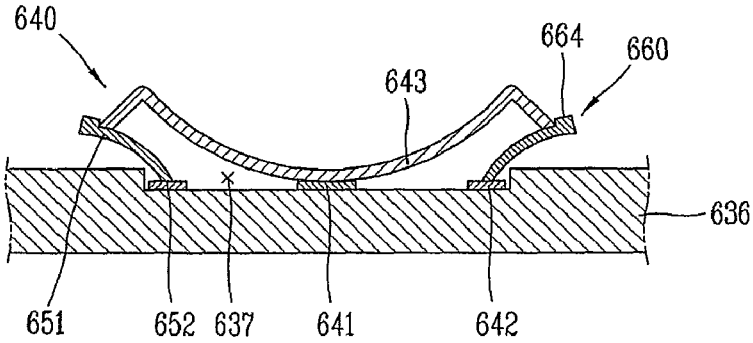
Figure 17:
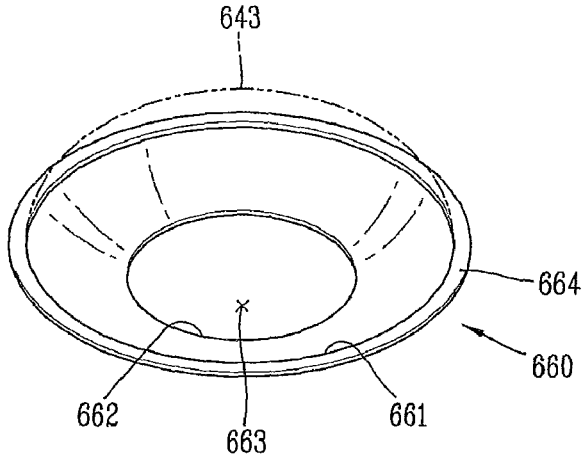
FIG. 17 is a perspective view showing an elastic supporting member shown in FIGS. 16*a* to 16*c;*

FIGS. 16A to 16C are sectional views of a dome switch in accordance with a $6^{th}$ embodiment of the present invention, and FIG. 17 is a perspective view of an elastic supporting member shown in FIGS. 16A to 16C.

A dome switch 640 according to this embodiment may include a plurality of conductors 641 and 642 patterned on a printed circuit board 636, a metal dome 643 transformed responsive to the key button 123*a* being pressed so as to electrically connect the conductors 641 and 642, and an elastic supporting member 660 for supporting the metal dome 643 and elastically moving a supported point of the metal dome 643 when the key button 123*a* is pressed.

According to this embodiment, the conductors 641 and 642 may include a first conductor 641 located at a central portion and a second conductor 642 formed at an outer periphery of the first conductor 641. Here, the first and second conductors 641 and 642 may be formed on an upper surface of the printed circuit board 636.

The first and second conductors 641 and 642 may be disposed at a recess portion 637 recessed into the printed circuit board 636 by a predetermined depth. This structure allows the use of the elastic supporting member 660 to affect the thickness of the portable terminal as less as possible.

The metal dome 643 is maintained in the state of being electrically connected to the second conductor 642. When the key button 123*a* is pressed, the push protrusion 123*b* in turn pushes the metal dome 643, which is accordingly transformed. Consequently, the metal dome 643 contacts the first conductor 641 so as to electrically connect the first and second conductors 641 and 642 to each other.

This embodiment exemplarily illustrates, as shown in FIG. 17, that the elastic supporting member 660 is implemented in a type of washer having an inclination surface in a radial direction. However, the elastic supporting member 660 may be implemented in any type or form if it can elastically support a supported point of the metal dome 643.

The elastic supporting member 660 may be disposed between the metal dome 643 and the second conductor 642. The elastic supporting member 660 may be formed of a conductive material so as to electrically connect the metal dome 643 to the second conductor 642. The elastic supporting member 660 may include a first supporting portion 661 for supporting the periphery of an edge of the metal dome 643, and a second supporting portion 662 extending from the first supporting member 661 and supported by the second conductor 642.

The first supporting portion 661 may be provided with a stopping protrusion 664 stopped at a supported point of the metal dome 643. The stopping protrusion 664 may be implemented by forming a stepped portion at an upper surface of the elastic supporting member 660.

The second supporting portion 662 may extend from the first supporting portion 661 to be inclined in a radial direction of the metal dome 643. The second supporting portion 662 may be supported by the second conductor 642 in a state of not being attached or fixed onto the second conductor 642 as shown in this embodiment; however, it may be attached or fixed onto the second conductor 642. Alternatively, the second supporting portion 642 may be integrally formed with the second conductor 642 by being made of the same material to that of the second conductor 642.

A through hole 663 through which the central portion of the metal dome 643 comes in contact with the first conductor 641 upon the transformation of the metal dome 643 may be formed through the central region of the elastic supporting member 660, namely, inside the second supporting portion 662.

An operation state of the dome switch 640 according to this embodiment will now be described.

Referring to FIG. 16*b*, when the push protrusion 123*b* presses the metal dome 643, the elastic supporting member 660 is transformed close to the upper surface of the printed circuit board 636. In addition, the metal dome 643 is kept pressed so as to be transformed at a central portion thereof.

If the metal dome 643 is transformed more than a preset level, as shown in FIG. 6C, the elastic supporting member 660 is restored to the original state. Here, the restoring force of the elastic supporting member 660 and the force applied by the push protrusion 123*b* causes buckling at the edge of the metal dome 643. The operation of such dome switch 640 may increase TRS as described above.

Figure 18:
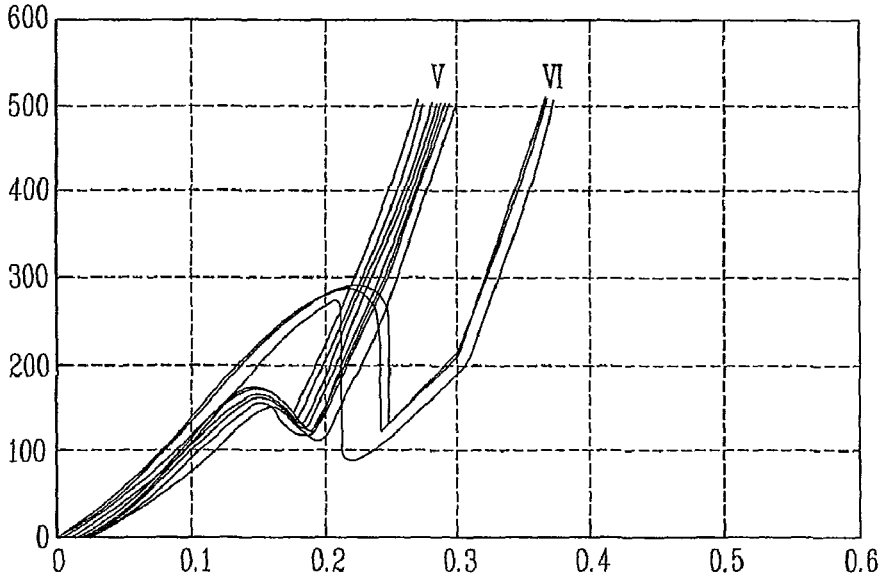
FIG. 18 is a graph showing comparison results of forces applied to a metal dome before and after employing the elastic supporting member.

FIG. 18 is a graph showing comparison results of forces applied to a metal dome before and after employing the elastic supporting member. The left graph V of FIG. 18 represents the results before employing the elastic supporting member 660, and the right graph VI represent the results after employing the elastic supporting member 660.

The following table shows comparison results of TRS values based upon the graph of FIG. 18.

| | Before employment | After employment |
|---|---|---|
| CP (gf) | 172 | 323 |
| CL | 125 | 172 |
| Click ratio (%) | 27.2 | 46.7 |
| TRS | 1514 | 10512 |
| S1 | 0.177 | 0.302 |
| S2 | 0.208 | 0.316 |

Referring to the table, it can be noticed that the TRS after employment of the elastic supporting member 160 has been increased 6 times higher than that before employment thereof and the click ratio has been increased more than 20%.

Figure 19A:
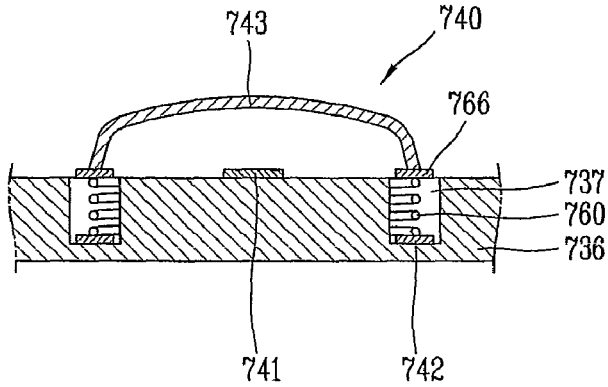
FIGS. 19A to 19C are sectional views showing a dome switch in accordance with a $7^{th}$ embodiment of the present invention.
Figure 19B:
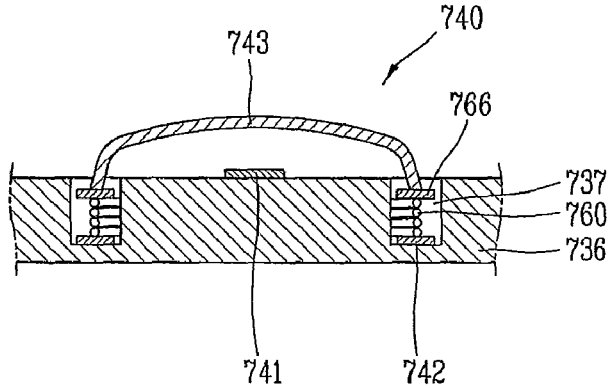
Figure 19C:
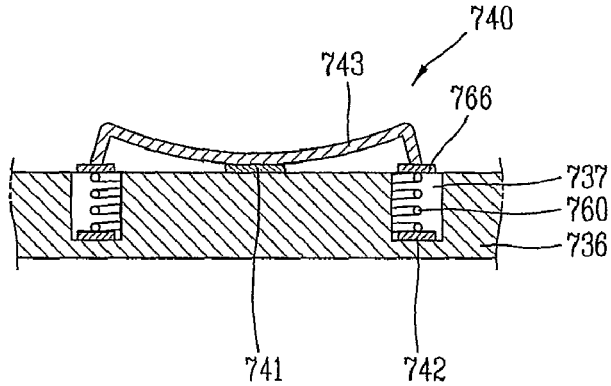

FIGS. 19A to 19C are sectional views showing a dome switch in accordance with a $7^{th}$ embodiment of the present invention. These drawings represent similar reference numerals to the same components to those in the previous embodiments.

A dome switch 740 according to this embodiment may include a plurality of conductors 741 and 742 patterned on a printed circuit board 736, a metal dome 743 transformed when the key button 123*a* is pressed so as to electrically connect the conductors 741 and 742, and an elastic supporting member 760 for supporting the metal dome 743 and elastically moving a supported point of the metal dome 743 when the key button 123*a* is pressed.

The conductors 741 and 742 according to this embodiment may also include the first conductor 741 and the second conductor 742. This embodiment exemplarily illustrates a structure in which the first conductor 741 is formed at an upper surface of the printed circuit board 736 and the second conductor 742 is formed inside the printed circuit board 736.

The elastic supporting member 760 may be implemented as a metallic spring 760 for supporting an edge of the metal dome 743. The spring 760 may be electrically connected to the second conductor 742 within the printed circuit board 736.

The printed circuit board 736 may include a recess portion 737 with a predetermined depth. Here, the recess portion 737 may be formed at an outer periphery of the first conductor 741, and the second conductor 742 may be disposed in the recess portion 737.

The spring 760 may be a type of coil spring inserted into the recess portion 737, and have one end supported by the second conductor 742 and another end supporting a supported point of the metal dome 743. A ring-shaped metallic member 766 may further be mounted between the supported point of the metal dome 743 and the spring 760.

The operation state of the dome switch 740 according to this embodiment will now be described.

As shown in FIG. 19*b*, the spring 760 may be compressed by a force that the push protrusion 123*b* presses the metal dome 743. Also, as the metal dome 743 is kept pressed, the central portion of the metal dome 743 may also be transformed.

When the metal dome 743 is transformed more than a preset level, the spring 760 extends to its original state as shown in FIG. 19C. Here, buckling may be generated at the edge of the metal dome 243 by the restoring force of the spring 760 and the force applied by the push protrusion 123*b*. Consequently, the operation of the dome switch is transferred to a user in a type of click feeling.

Figure 20:
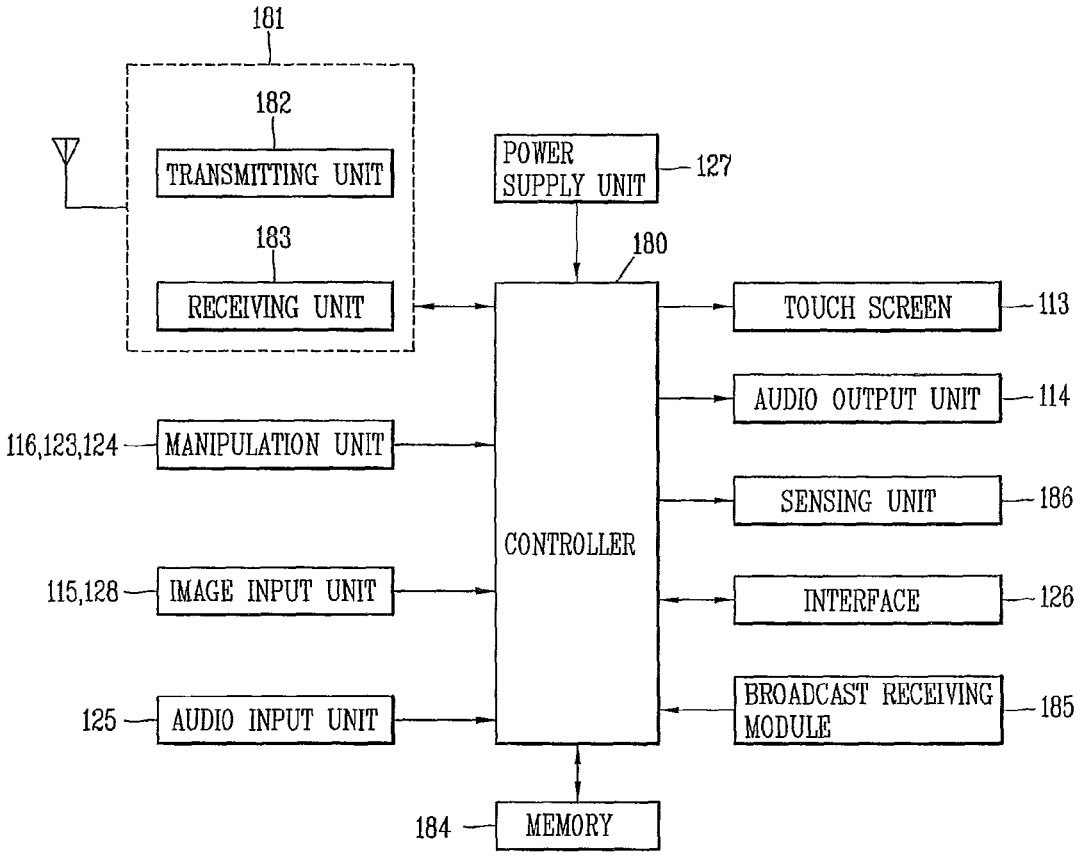
FIG. 20 is a block diagram showing a portable terminal in accordance with one embodiment of the present invention.

FIG. 20 is a block diagram showing a portable terminal in accordance with one embodiment of the present invention.

Referring to FIG. 20, the portable terminal may includes components, such as a wireless communication unit 181, manipulation units 116, 123 and 124, video input units 115 and 128, an audio input unit 125, a display 113, audio output units 114 and 131, a sensing unit 186, an interface unit 126, a broadcast receiving module 185, a memory 184, a power supply unit 127 and a controller 180.

The controller 180 typically controls the overall operations of the portable terminal. For example, the controller 180 may perform related control and processing for voice call communication, data communication, telephony communication and the like.

The wireless communication module 181 may transmit and receive radio signals with a mobile communication base station via an antenna. For example, the wireless communication module 181 manages transmission and reception of audio data, text data, video data and control data under the control of the controller 180. To this end, the wireless communication module 181 may include a transmitting unit 182 for modulating and transmitting a signal to be sent, and a receiving unit 183 for demodulating a signal received.

The manipulation units 116, 123, 124 may be configured, as shown in FIG. 1, thus to provide the controller 180 with key input data input by a user to control the operations of the portable terminal. The manipulation units 116, 123, 124 may include a dome switch, a touchpad (e.g., static pressure/capacitance), a jog wheel, a jog switch and the like.

The video input units 115 and 128 process image frames of still images or video obtained by an image sensor in a video call mode or a capturing mode. Such processed image frames are converted into image data displayable on the display 113 to be then output on the display 113.

The image frames processed by the video input units 115 and 128 may be stored in the memory 184 under the control of the controller 180 or be sent to the exterior via the wireless communication module 181.

The audio input unit 125 receives an external audio signal via a microphone while the portable terminal is in a particular mode, such as phone call mode, recording mode and voice recognition. This audio signal is processed and converted into digital data. Such processed digital data is converted into a data format transmittable to a mobile communication base station via the wireless communication module 181 when the portable terminal is in the phone call mode, and then outputted to the wireless communication module 181. The processed digital data may be stored in the memory 184 in a recording mode.

The audio input unit 125 may include assorted noise removing algorithms to remove noise generated in the course of receiving the external audio signal.

The display 113 displays information processed in the portable terminal. For example, when the portable terminal is in a phone call mode, the display 113 displays User Interface (UI) or (Graphic User Interface (GUI) related to the call under the control of the controller 180. If the portable terminal operates in a telephony call mode or capturing mode, the captured image or UI or GUI may be displayed under the control of the controller 180. If the display 113 includes a touch screen, it may be used as an input device as well as an output device.

The audio output units 114 and 131 may convert audio data received from the wireless communication module 181 or audio data stored in the memory 184 under the control of the controller 180 when the portable terminal is in the call-receiving mode, a phone call mode, a recording mode, a voice recognition mode, or a broadcast receiving mode. Such converted audio data is then outputted to the exterior.

The audio output units 114 and 131 also output an audio signal associated with a function (e.g., outputting a call receiving sound, a message receiving sound, or the like) performed in the portable terminal. Such audio output units 114 and 131 may include a speaker, a receiver, a buzzer and the like.

The sensing unit 186 provides status measurements of various aspects of the portable terminal. For instance, the sensing unit 166 may detect an open/close status of the portable terminal, a change of position of the portable terminal or a component of the portable terminal, a presence or absence of user contact with the portable terminal and the like, thereby generating a sensing signal for controlling the operation of the portable terminal. For example, the sensing unit 186 senses the open or closed state of a slide type portable terminal, and outputs the sensed result to the controller 180, such that the operation of the portable terminal can be controlled. Other examples include the sensing unit 186 sensing the presence or absence of power provided by the power supply 127, the presence or absence of a coupling or other connection between the interface 126 and an external device.

The interface 126 is often implemented to couple the portable terminal with external devices. Typical external devices include wired/wireless headphones, external chargers, wired/wireless data ports, card sockets (e.g., memory card, SIM/UIM card or the like) and the like. The interface 126 may allow the portable terminal to receive data or power from external devices and transfer such data or power to each component inside the portable terminal, or transmit internal data of the portable terminal to external devices.

The memory 184 may store a program for the control and processing of the controller 180, or temporarily store input/output data (e.g., phone book data, messages, still images, video or the like).

Also, the memory 184 may store a program for controlling the operation of the portable terminal according to the present invention.

The memory 184 may include typically known hard disk, a card-type memory (e.g., SD or XD memory), a flash memory, RAM, ROM and the like.

The broadcast receiving module 185 may receive a broadcast signal transmitted via satellites or terrestrial waves and convert such broadcast signal into a broadcast data format capable of being output to the audio output units 114 and 131 and the display 113 so as to output the converted signal to the controller 180. The broadcast receiving module 185 may also receive additional data associated with broadcasting (e.g., Electric Program Guide (EPG), channel list, or the like). The broadcast data converted in the broadcast receiving module 185 and the additional data may be stored in the memory 184.

The power supply 127 provides power required by the various components for the portable terminal. The provided power may be internal power, external power, or combinations thereof.

As described above, the present invention provides a dome switch configured so that a contact surface of a first conductor is located lower than a support surface of a second conductor so as to increase a stroke upon transformation of a metal dome, thereby increasing click ratio, resulting in providing enhanced click feeling.

Also, the present invention provides a dome switch configured so that a structure of elastically moving a supported point of a metal dome upon transformation of the metal dome is implemented to thus improve TRS of the metal dome, resulting in providing enhanced click feeling.

The aforesaid configuration and method for the mobile terminal is not to be construed as limiting the present disclosure. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A portable terminal comprising:

a first conductor patterned on a board;

a second conductor patterned on an outer periphery of the first conductor;

a metal dome electrically connected to the second conductor and transformed responsive to a key being pressed so as to contact the first conductor; and an elastic supporting member configured to support a supported point of the metal dome in a state of being supported by the second conductor, and elastically move the support point of the metal dome when the key is pressed, wherein the elastic supporting member has an elastic index smaller than that of the metal dome.

2. The terminal of claim 1, wherein the first and second conductors are disposed at a recess portion recessed into the board by a predetermined depth.

3. The terminal of claim 1, wherein the elastic supporting member is a spring formed of a metal for supporting an edge of the metal dome.

4. The terminal of claim 3, wherein the spring is disposed within a recess portion recessed into the board.

5. The terminal of claim 1, wherein the elastic supporting member comprises:

a first supporting portion configured to support a periphery of an edge of the metal dome; and a second supporting portion extending from the first supporting portion and supported by the second conductor.

6. The terminal of claim 5, wherein the first supporting portion is provided with a stopping protrusion stopped at a supported point of the metal dome.

7. The terminal of claim 5, wherein a through hole configured to contact the first conductor with a central portion of the metal dome is formed at an inner side of the second supporting portion.

8. The terminal of claim 5, wherein the second supporting portion extends to be inclined in a radial direction of the metal dome.

* * * * *